US009032915B2

(12) United States Patent
Tobergte et al.

(10) Patent No.: US 9,032,915 B2
(45) Date of Patent: May 19, 2015

(54) INDEPENDENT COOLING OF CYLINDER HEAD AND BLOCK

(71) Applicant: Ford Global Technologies, LLC, Dearborn, MI (US)

(72) Inventors: Michael Tobergte, Cologne (DE); Bert Pingen, Swisttal (DE); Bernd Schumacher, Langenfeld (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 14 days.

(21) Appl. No.: 13/948,965

(22) Filed: Jul. 23, 2013

(65) Prior Publication Data

US 2014/0026829 A1 Jan. 30, 2014

(30) Foreign Application Priority Data

Jul. 30, 2012 (DE) ..... 10 2012 213 341

(51) Int. Cl.
*F01P 3/02* (2006.01)
*F01P 7/14* (2006.01)

(52) U.S. Cl.
CPC ... *F01P 3/02* (2013.01); *F01P 7/14* (2013.01); *F01P 2007/146* (2013.01)

(58) Field of Classification Search
USPC ..... 123/41.1, 41.01, 41.08, 41.4
See application file for complete search history.

(56) References Cited

U.S. PATENT DOCUMENTS 6,164,248 A * 12/2000 Lehmann ..... 123/41.1
6,789,512 B2 * 9/2004 Duvinage et al. ..... 123/41.05

FOREIGN PATENT DOCUMENTS

DE 38 29 620 A1 * 3/1990 ..... A47L 15/42
DE 10061546 A1 8/2002
DE 10392436 T5 6/2005
DE 102007048503 A1 4/2008
DE 102010036581 A1 1/2012

* cited by examiner

*Primary Examiner* — Lindsay Low
*Assistant Examiner* — Kevin Lathers
(74) *Attorney, Agent, or Firm* — Julia Voutyras; Alleman Hall McCoy Russell & Tuttle LLP

(57) ABSTRACT

Various systems are provided for liquid-cooling of an internal combustion engine. In one example, an internal combustion engine includes a cylinder head, a cylinder block coupled to the cylinder head, a first return line fluidically coupled to the cylinder head and to a coolant valve and including a heat exchanger configured to remove heat from coolant, a second return line fluidically coupled to the cylinder block and to the coolant valve, a bypass line branching off from the first return line and fluidically coupled to the coolant valve, and an originating supply line fluidically coupled to the cylinder head, the cylinder block, and the coolant valve, the originating supply line including a pump configured to supply coolant. The coolant valve is configured to control coolant flow through the coolant lines via rotational selection of one of a plurality of working positions.

19 Claims, 5 Drawing Sheets

INDEPENDENT COOLING OF CYLINDER HEAD AND BLOCK

CROSS REFERENCE TO RELATED APPLICATIONS

The present application claims priority to German Patent Application No. 102012213341.0, filed on Jul. 30, 2012, the entire contents of which are hereby incorporated by reference for all purposes.

FIELD

The disclose relates to independently cooling a cylinder head and a cylinder block in an internal combustion engine.

BACKGROUND AND SUMMARY

An internal combustion engine which is liquid-cooled may include at least one coolant jacket positioned in the cylinder head and/or block of the engine. Coolant may be supplied to an inlet of the coolant jacket, circulated through the cylinder head and/or block thereby cooling the engine, and expelled via an outlet of the coolant jacket at which point the heated coolant may be supplied to a heat exchanger where heat may be extracted from the coolant and expelled to the ambient environment or another location such as a passenger compartment. Liquid cooling is being increasingly implemented in internal combustion engines as the use of superchargers and turbochargers has become more prevalent, and as engine components (e.g., exhaust manifolds) are being increasingly integrated into the cylinder head and/or block to achieve dense packaging. Generally, the cylinder head is more thermally loaded than the cylinder block, due to its relatively lower mass, possession of lines which conduct hot exhaust gas, and the relatively longer exposure to high temperatures of its combustion chamber walls compared to the cylinders disposed in the cylinder block. As such, different cooling strategies respective to the cylinder head and block may be sought. For example, it may be sought to cool the cylinder head more thoroughly than the block as operation of the valve actuation system may be optimized at relatively lower temperatures by avoiding mixed friction in its bearings, whereas friction losses between cylinder liners and pistons may be minimized by maintaining the cylinder block at relatively higher temperatures.

German pat. app. no. DE 100 61 546 A1 describes a cooling system for an internal combustion engine which is cooled via a liquid coolant. To control the quantities of coolant which flow through coolant lines of a cylinder head and through coolant lines of a cylinder block, dedicated thermostat valves are positioned downstream of the cylinder head and block. Here, the thermostat valve of the cylinder head has a lower opening temperature than the thermostat valve of the cylinder block. Here, a thermostat valve with an invariant, component-specific operating temperature is selected to be suitable for all load states and therefore have an opening temperature configured for high loads, which is comparatively low and leads to relatively low coolant temperatures even in part-load operation. A low coolant temperature in part-load operation correlates with a relatively large temperature difference between the coolant and the component.

The inventors herein have recognized several issues with such an approach. With such a cooling system, a relatively large amount of heat transfer occurs at low and medium loads, which reduces efficiency during part-load operation. Further, two thermostat valves are utilized, increasing cost, complexity of control routines, weight, and packaging space.

To address these issues, systems providing demand-based independent cooling of a cylinder head and block in an internal combustion engine are provided.

In one example, an internal combustion engine includes a cylinder head, a cylinder block coupled to the cylinder head, a first return line fluidically coupled to the cylinder head and to a coolant valve and including a heat exchanger configured to remove heat from coolant, a second return line fluidically coupled to the cylinder block and to the coolant valve, a bypass line branching off from the first return line and fluidically coupled to the coolant valve, and an originating supply line fluidically coupled to the cylinder head, the cylinder block, and the coolant valve, the originating supply line including a pump configured to supply coolant. The coolant valve is configured to control coolant flow through the first return line, the second return line, the bypass line, and the originating supply line via rotational selection of one of a plurality of working positions.

In this way, independent cooling of a cylinder head and block may be facilitated based on demand, including scenarios in which maximum extraction of heat from an engine is not desired.

DETAILED DESCRIPTION

Some internal combustion engines utilize liquid cooling to reduce component temperatures, such as temperatures of a cylinder head and a cylinder block. As the cylinder head and block have different operating characteristics, and operate optimally at different temperatures, different cooling strategies specific to the cylinder head and block may be chosen. In some approaches, thermostat valves are positioned downstream of the cylinder head and block, respectively, each having different opening temperatures. However, a relatively large amount of heat transfer may occur at low and medium loads, reducing efficiency during part-load operation. Further, the inclusion of multiple thermostat valves increases cost, complexity of control routines, weight, and packaging space.

Various systems are provided, facilitating demand-based independent cooling of a cylinder head and block in an internal combustion engine. In one example, an internal combustion engine includes a cylinder head, a cylinder block coupled to the cylinder head, a first return line fluidically coupled to the cylinder head and to a coolant valve and including a heat exchanger configured to remove heat from coolant, a second return line fluidically coupled to the cylinder block and to the coolant valve, a bypass line branching off from the first return line and fluidically coupled to the coolant valve, and an originating supply line fluidically coupled to the cylinder head, the cylinder block, and the coolant valve, the originating supply line including a pump configured to supply coolant. The coolant valve is configured to control coolant flow through the first return line, the second return line, the bypass line, and the originating supply line via rotational selection of one of a plurality of working positions.

Figure 1:
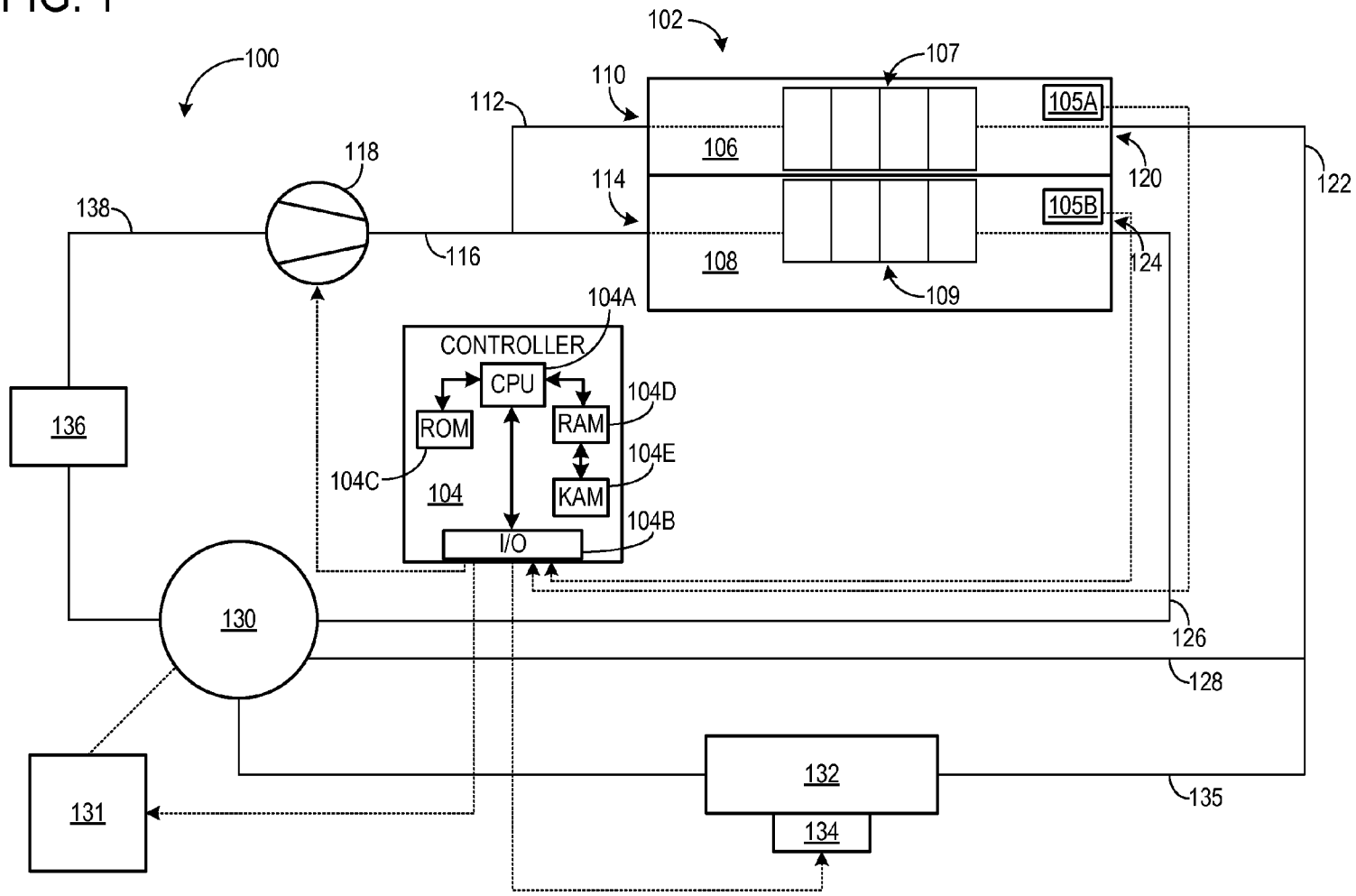
FIG. 1 shows a block diagram of an internal combustion engine including a coolant circuit.
Figure 2A:
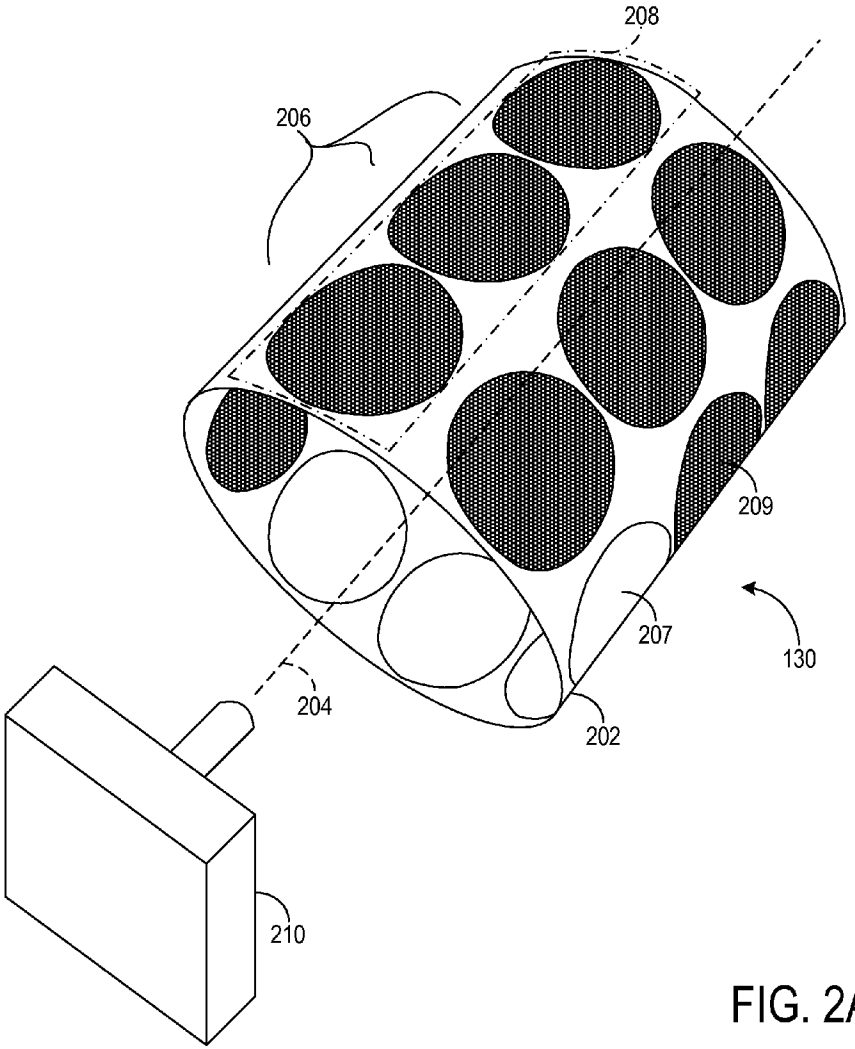
FIG. 2A shows an example of a coolant valve positioned in the coolant circuit of FIG. 1.
Figure 2B:
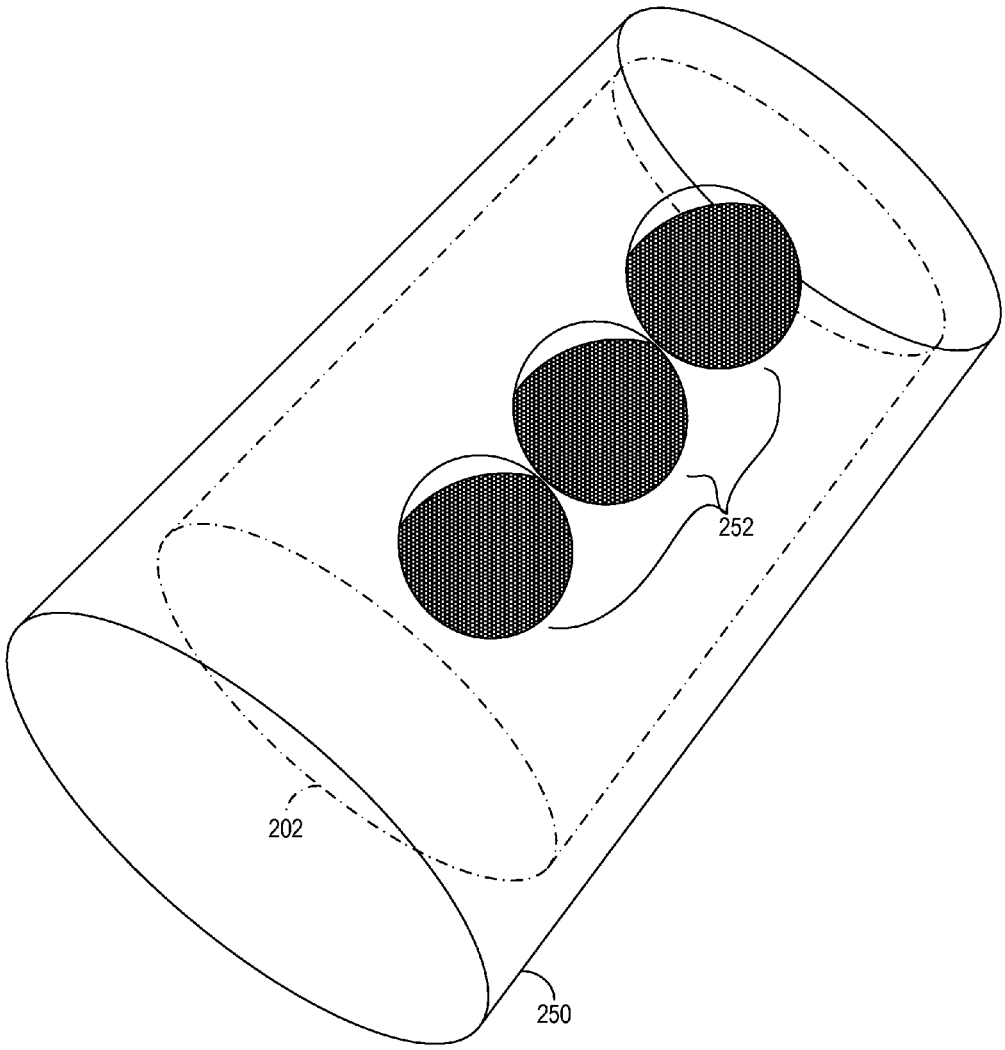
FIG. 2B shows an example of a housing in which the coolant valve of FIG. 2A is positioned.
Figure 3:
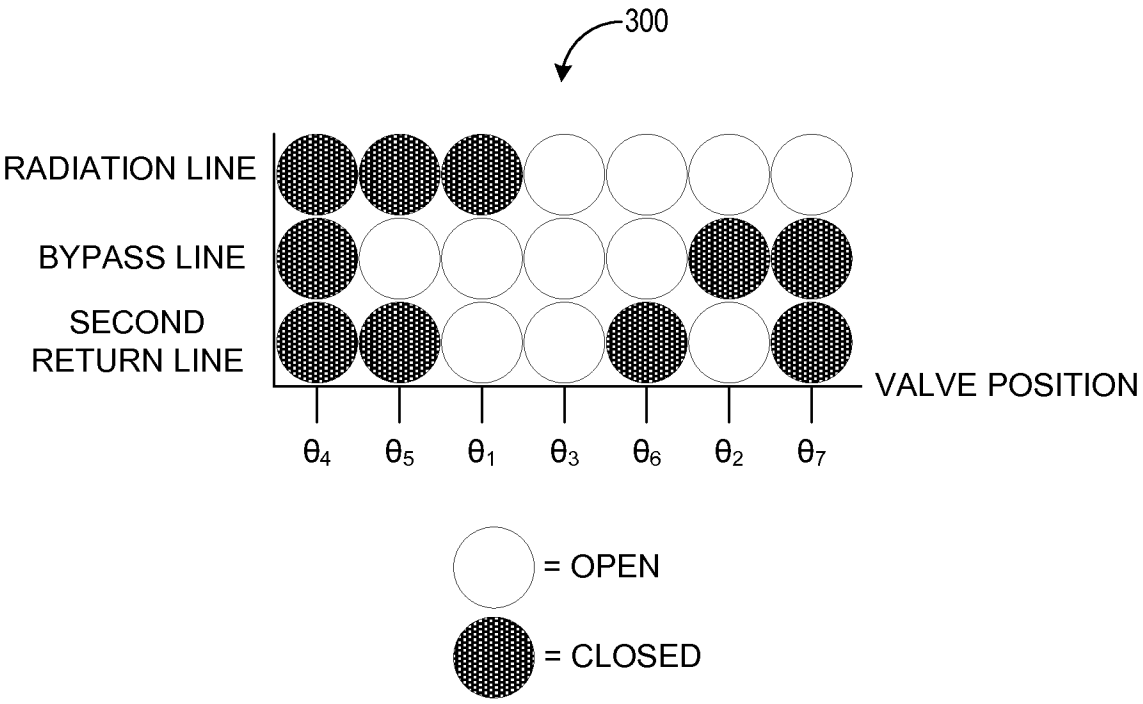
FIG. 3 schematically shows a plurality of working positions of the coolant valve of FIG. 2A.
Figure 4:
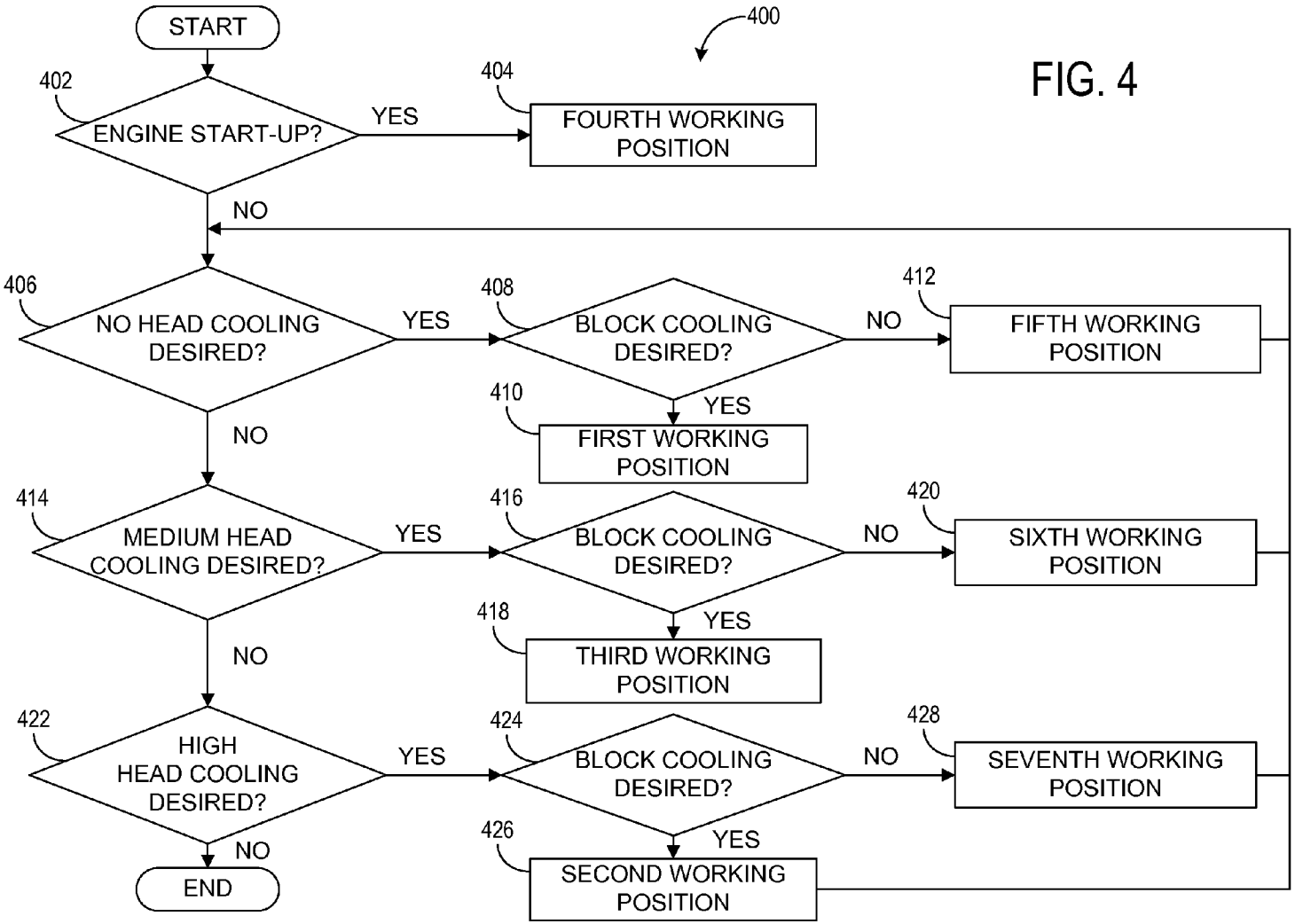
FIG. 4 shows a flowchart illustrating a method for controlling coolant flow through the coolant circuit of FIG. 1 with the coolant valve of FIG. 2A.

FIG. 1 shows a block diagram of an internal combustion engine including a coolant circuit. FIG. 2A shows an example of a coolant valve positioned in the coolant circuit of FIG. 1. FIG. 2B shows an example of a housing in which the coolant valve of FIG. 2A is positioned. FIG. 3 schematically shows a plurality of working positions of the coolant valve of FIG. 2A. FIG. 4 shows a flowchart illustrating a method for controlling coolant flow through the coolant circuit of FIG. 1 with the coolant valve of FIG. 2A. The engine of FIG. 1 also includes a controller configured to carry out the method depicted in FIG. 4.

FIG. 1 shows a schematic diagram of a coolant circuit 100 fluidically coupled to an internal combustion engine 102. Engine 102 may be a diesel engine, a spark-ignited gasoline engine, or a hybrid internal combustion engine, for example, and may be included in the propulsion system of an automobile. Engine 102 may comprise a plurality of cylinders (e.g., four) and may be operated by a control system including a controller 104 and by input from a vehicle operator. Controller 104 is shown in FIG. 1 as a microcomputer, including microprocessor unit (CPU) 104A, input/output ports (I/O) 104B, an electronic storage medium for executable programs and calibration values shown as read only memory (ROM) chip 104C in this particular example, random access memory (RAM) 104D, keep alive memory 104E, and a data bus. Controller 104 may receive various signals from sensors coupled to engine 102, including but not limited to indications of inducted mass air flow, temperatures of a cylinder head and a cylinder block described in further detail below provided respectively via cylinder head temperature sensor 105A and cylinder block temperature sensor 105B, engine coolant temperature, a profile ignition pickup from a Hall effect sensor (or other type) coupled to a crankshaft (not shown), throttle position, and absolute manifold temperature. Controller 104 may further supply signals and commands to various components of coolant circuit 100 and engine 102, such as a stepper motor described in further detail below.

The cylinders (not shown) in engine 102 may each include a piston (not shown) positioned therein. The pistons may be coupled to a crankshaft (not shown) such that reciprocating motion of the piston is translated into rotational motion of the crankshaft. The crankshaft may be coupled to at least one drive wheel of a vehicle via an intermediate transmission system (not shown). Further, the cylinders may receive intake air from an intake manifold (not shown) via an intake passage (not shown) and may exhaust combustion gases via an exhaust passage (not shown). The intake and exhaust manifolds may selectively communicate with each cylinder via respective intake valves and exhaust valves (not shown). In some embodiments, the cylinders may include two or more intake valves and/or two or more exhaust valves.

Fuel injectors (not shown) may be coupled directly to each cylinder for injecting fuel directly therein. The injection may be in proportion to a pulse width of a signal received from controller 104. In this manner, the fuel injectors provide what is known as direct injection of fuel into the cylinders. The fuel injectors may be mounted in the side of the cylinders or in the top of the cylinders, for example. Fuel may be delivered to the fuel injectors by a fuel system (not shown) including a fuel tank, a fuel pump, and a fuel rail. In some embodiments, the cylinders may alternatively or additionally include a fuel injector arranged in the intake manifold in a configuration that provides what is known as port injection of fuel into the intake port upstream from each cylinder.

As shown, engine 102 includes a cylinder head 106 coupled to a cylinder block 108 positioned therebelow, which together may form a plurality of cylinders (not shown). Cylinder head 106 may be coupled to cylinder block 108 by various suitable methods (e.g., bolting), or in other embodiments the cylinder head and block may be integrally formed as a single unit. In the illustrated example, cylinder head 106 and cylinder block 108 respectively include a head coolant jacket 107 and a block coolant jacket 109 each integrated respectively therein, both configured to remove heat from proximate regions (e.g., cylinders) of engine 102 and transfer extracted heat to coolant flowing therein. Here, coolant jackets 107 and 109 comprise a number of sections corresponding to the number of cylinders in engine 102 (e.g., four) which are in mutual fluidic communication. In other embodiments, coolant jackets 107 and 109 may each be unitary, contiguous coolant jackets positioned to surround the cylinders in engine 102. Still further, coolant jackets may be provided which extend throughout both cylinder head and block 106 and 108, and may comprise individual sections in fluidic communication or may be a single, unitary, contiguous coolant jacket.

Cylinder head 106 includes a first supply opening 110 to which a first supply line 112 is fluidically coupled and configured to supply coolant to the cylinder head and head coolant jacket 107. Likewise, cylinder block 108 includes a second supply opening 114 to which a second supply line 116 is fluidically coupled and configured to supply coolant to the cylinder block and block coolant jacket 109. First and second supply lines 112 and 116 may receive coolant from an upstream pump 118. Pump 118 may be any suitable pump capable of supplying adequate coolant pressure in coolant circuit 100, and may deliver coolant from a suitable reservoir (not shown) configured to store coolant. The coolant, for example, may be water, one or more suitable chemical coolants, or a mixture thereof (e.g., a water-glycol mixture having additives).

Having flowed through cylinder head 106, and head cooling jacket 107, coolant exits the cylinder head at a first discharge opening 120 and is expelled through a first return line 122. Similarly, coolant exits cylinder block 108 at a second discharge opening 124 and is expelled through a second return line 126. First return line 122, second return line 126, and a bypass line 128 branching off from the first return line join and are fluidically coupled to a coolant valve 130 described in further detail below. Coolant valve 130 may be controlled by a suitable actuator 131 in turn controlled by controller 104, the actuator also described in further detail below.

Positioned upstream coolant valve 130 and downstream bypass line 128, a heat exchanger 132 is configured to extract heat from coolant expelled from cylinder head 106. Heat exchanger 132 may be of various suitable types, including but not limited to a liquid-to-air heat exchanger or a liquid-to-liquid heat exchanger, and may expel extracted heat to the ambient atmosphere or to other regions of engine 102. Heat exchanger 132 may be a radiator, for example. In embodiments in which heat exchanger 132 is a liquid-to-air heat exchanger, a fan motor 134 may be provided to set in rotation a fan impeller (not shown). In this way, an adequately large mass flow of air may be provided to heat exchanger 132 to assist heat transfer in all engine operating states. Fan motor 134 may be electrically operated, for example, and controlled in a continuously variable manner via controller 104 with different loads or rotational speeds. The portion of first return line 122 downstream of bypass line 128 which includes heat exchanger 132 and fluidically couples the heat exchanger to coolant valve 130 may be designated a radiation line 135.

Positioned downstream coolant valve 130, and upstream pump 118 and first and second supply lines 112 and 116, is a heating device 136 operated via heated coolant (e.g., a coolant-operated heater) expelled from cylinder head and block 106 and 108. Heating device 136 may be a cabin heater configured to provide heat to a passenger compartment, for example, and may include a fan (not shown). Heating device 136 is fluidically coupled to pump 118 via an originating supply line 138, completing coolant circuit 100. Other arrangements are possible, however, in which heating device 136 is positioned in other locations, such as upstream heat exchanger 132 in first return line 122.

Although first and second supply lines 112 and 116, first and second return lines 122 and 126, and bypass line 128 are shown as discrete physical lines in fluidic communication with various components of coolant circuit 100, it will be appreciated that one or more of these lines may be integrated in cylinder head 106, cylinder block 108, or another component (e.g., another location in engine 102).

Coolant valve 130, introduced above, includes a plurality of working positions which control coolant flow through originating supply line 138, first and second supply lines 112 and 116, first and second return lines 122 and 126, and bypass line 128. Coolant valve 130 effects different couplings among such lines, thereby facilitating independent cooling of cylinder head and block 106 and 108. In the depicted embodiment, first return line 122 (e.g., radiation line 135), second return line 126, and bypass line 128 serve as three inlet lines to coolant valve 130, while originating supply line 138 serves as a single outlet line.

Coolant circuit 100 and engine 102 may include other components not shown. For example, coolant circuit 100 may include a degassing line configured to relieve high pressures in the coolant circuit and thus prevent degradation of the coolant circuit and ensure its sufficient operation. In one embodiment, the degassing line may branch off from radiation line 135 and fluidically connect to a device configured to extract gasses from coolant flowing therethrough, which may be vented to the ambient atmosphere or another suitable location. The degassing line may continue downstream of the gas extraction device, connecting fluidically to cylinder head 106 and/or heat exchanger 132, for example.

Turning now to FIG. 2A, an exemplary embodiment of coolant valve 130 is shown. In this example, coolant valve 130 is a rotary valve having a cylindrical body (e.g., control drum) 202 including a plurality of ports arranged in columnar regions aligned about a longitudinal axis 204 of the coolant valve. For example, coolant valve 130 includes three ports 206 positioned in a first columnar region 208. In this example, coolant valve 130 includes seven columnar regions each defining a working position of the coolant valve and controlling coolant flow among the various lines in coolant circuit 100 of FIG. 1. Non-shaded ports (e.g., port 207) represent open, hollow regions through which coolant may flow upon connection of one line to another, while shaded ports (e.g., port 209) represent solid regions of coolant valve 130 which are contiguous with the surrounding surface of the coolant valve and which block coolant flow. Ports 206 selectively block or allow coolant flow. Coolant valve 130 may be formed via various suitable methods, such as injection molding or machining, for example, and may be physically actuated by a motor 210 described in further detail below.

Longitudinal axis 204 also represents an axis about which coolant valve 130 may rotate and thereby select among its various working positions (e.g., columnar regions) and control coolant flow among the various lines in coolant circuit 100. The rotational selection working positions of coolant valve 130 may be controlled by motor 210, described in further detail below. FIG. 2B shows an exemplary arrangement in which coolant valve 130 is positioned and rotatable in a block or housing 250 having, in this example, three external ports or connection openings 252 disposed on its external surface. Both block 250 and external ports 252 are geometrically contoured to match the geometry of coolant valve 130 such that accurate rotation, working position selection, coolant flow, and line connection are ensured as each working position (e.g., columnar region) is aligned (e.g., laterally) to the external ports. In this embodiment, external ports 252 are respectively connected to the three lines per the connections shown in FIG. 1—second return line 126, bypass line 128, and radiation line 135, and may be fluidically sealed to such ports in a suitable manner. External ports 252, and second return line 126, bypass line 128, and radiation line 135, may be adjacent to the (lateral) surface of coolant valve 130, for example. Thus, the rotation of coolant valve 130, along with the selective conduction and blockage of coolant provided by ports 206, facilities coolant control among the various lines of coolant circuit 100. The working positions of coolant valve 130 and their affect on coolant flow through such lines is described in greater detail below with reference to FIG. 3.

It will be appreciated that the embodiments of coolant valve 130 and block 250 shown in FIGS. 2A and 2B are exemplary and not intended to be limiting in any way. Alternative arrangements are possible in which a coolant valve is provided having a disk-shaped geometry, with a suitably-shaped block provided to facilitate coolant control described above. In such a case, second return line 126, bypass line 128, and radiation line 135 may be adjacent to a face side of the disk (e.g., oriented transversely with respect to the axis of rotation of the disk). Further, coolant valve 130 may be endowed with other numbers of working positions and ports in each working position (e.g., columnar region) based on desired coolant control and component characteristics. Similarly, in other embodiments block 250 may have a total of four external ports 252 including two external ports respectively coupling coolant flow to first supply line 112 and second supply line 116 of FIG. 1.

Turning now to FIG. 3, a graph 300 schematically shows coolant flow or blockage through radiation line 135, bypass line 128, and second return line 126 as a function of each working position of coolant valve 130 and the couplings among these lines the coolant valve effects. Actuator 131 of FIG. 1 may rotate the coolant valve through its working positions each with specific residence times, described in further detail below. In this example, each working position of coolant valve 130 corresponds to an angular orientation of the coolant valve about longitudinal axis 204, where $\theta_4$ (e.g., 0°) is defined as the angle corresponding to the fourth working position. The plurality of working positions are described herein from left to right as shown in FIG. 3.

At the fourth working position corresponding to angle $\theta_4$, radiation line 135, bypass line 128, and second return line 126 are blocked via selection of an appropriate columnar region of coolant valve 130—for example, first columnar region 208 of FIG. 2A. In other words, coolant residing in these lines is not allowed to pass through coolant valve 130 and downstream of the coolant valve. Thus, radiation line 135, bypass line 128, and second return line 126 are separated from originating supply line 138 and first and second supply lines 112 and 116. The fourth working position facilitates deactivation of cooling of engine 102 of FIG. 1, as coolant is not circulated through cylinder head and block 106 and 108 but remains substantially stationary in coolant jackets 107 and 109. The fourth working position may be selected at startup and during warm-up of engine 102, and especially after a cold start, as warming of the cylinder head and block 106 and 108 is accelerated. Heating of oil in engine 102 is further expedited, reducing friction losses and fuel consumption.

At a fifth working position corresponding to angle $\theta_5$, bypass line 128 is connected to originating supply line 138 while radiation line 135 and second return line 126 remain blocked from the supply line. Like the fourth working position, the fifth working position may be suitable for quickly heating engine 102. However, coolant is allowed to circulate through cylinder head 106 and bypass heat exchanger 132 such that heated coolant may be provided to heating device 136 in order to heat a passenger compartment. The temperature of cylinder block 108 may be concurrently raised in a targeted manner. The fifth working position may be selected at startup of engine 102, for example.

At a first working position corresponding to angle $\theta_1$, second return line 126 is connected to originating supply line 138 while bypass line 128 also remains connected to the supply line and radiation line 135 remains blocked from the supply line. Here, heat is not extracted from coolant via heat exchanger 132, and coolant circulation is allowed through cylinder head and block 106 and 108. As with the fifth working position, heated coolant may be utilized by heating device 136 to provide heat to a passenger compartment. The first working position may be selected at startup of engine 102, for example.

At a third working position corresponding to angle $\theta_3$, all of radiation line 135, bypass line 128, and second return line 126 are connected to originating supply line 138. Here, heat is extracted from a portion of coolant in coolant circuit 100 via heat exchanger 132 while a remaining portion of the coolant bypasses the heat exchanger via bypass line 128. The third working position may be selected when partial cooling of engine 102 is desired, and further during an engine running condition (e.g., medium load, acceptable head, block, or coolant temperatures, etc.), for example.

At a sixth working position corresponding to an angle $\theta_6$, second return line 126 is blocked from originating supply line 138 while radiation line 135 and bypass line 128 remain connected to the supply line. The sixth working position may be selected when partial cooling of cylinder head 106 and an increase in the temperature of cylinder block 108 is desired. As with the third working position, the sixth working position may be selected when partial cooling of engine 102 is desired, and further during an engine running condition, for example.

At a second working position corresponding to an angle $\theta_2$, radiation line 135 remains connected to originating supply line 138. However, bypass line 128 is blocked from originating supply line 138, and second return line 126 is connected to the supply line. The second working position may be selected when it is desired that the degree to which cylinder head 106 is cooled is to be maximized, as coolant flowing through the cylinder head is entirely routed through heat exchanger 132 in radiation line 135. The second working position may thus be selected for an over-temperature condition at which one or more of a head, block, or coolant temperature has exceeded acceptable limits, for example.

At a seventh working position corresponding to an angle $\theta_7$, radiation line 135 remains connected to originating supply line 138 and bypass line 128 remains blocked from the supply line. However, second return line 126 is blocked from originating supply line 138. The seventh working position may be selected when maximum cooling of coolant flowing through cylinder head 106 is desired. Like the second working position, the seventh working position may be selected for an over-temperature condition of engine 102, for example.

In some embodiments, coolant valve 130 may transition through the above described working positions in a successive, linear cycle (e.g., in the order shown from left to right in FIG. 3). In this example, with one exception (transitioning from the sixth to the second working position), the state (e.g., blockage or connection) of one of radiation line 135, bypass line 128, and second return line 126 to originating supply line 138 is changed for each change in working position. This cycle, and other potential cycles, may optimize operation of coolant valve 130 for typical cycles of engine operation—for example, the above described cycle may be linearly traversed in the depicted order as engine operation proceeds and the temperatures of cylinder head 106 and block 108 vary (e.g., increase), minimizing the actuation required to operate the coolant valve, as the cycle is selected based on typical temperature changes in the cylinder head and block for typical engine operation cycles. Other embodiments are possible, however, in which the state of two or more of these lines may be changed for a given working position transition. Further, coolant valve 130 may be placed in any given working position in a non-successive order in other embodiments. As non-limiting examples, the angles of coolant valve 130 corresponding respectively to the above exemplary seven working positions are as follows: 0° (fourth working position), 51.5° (fifth working position), 103° (first working position), 154.5° (third working position), 206° (sixth working position), 257.5° (second working position), and 309° (seventh working position).

Motor 210, introduced above and shown in FIG. 2A, may drive rotation of coolant valve 130, its control drum, and selection of its working positions. In particular, motor 210 may be a stepper motor which moves coolant valve 130 from one working position to another via a predefined angle corresponding to at least one step of a predeterminable step size. In embodiments in which the seven working positions correspond to the exemplary angles provided above (e.g., 0°, 51.5°, 103°, 154.5°, 206°, 257.5°, and 309°), the predefined angle is 51.5°. The stepper motor facilitates transitions among working positions without substantial delay, and digitally adjusts the rotational orientation of coolant valve 130, as opposed adjusting in a continuously variable manner. Residence times for each working position may be predetermined or determined dynamically based on engine operating parameters. In some embodiments, operating parameters of engine 102 and/or coolant flowing therethrough, and/or characteristic maps, may be stored in motor 210 to facilitate demand-dependent coolant control.

In this way, independent cooling of cylinder head and block 106 and 108 appropriate to operating conditions and engine load is facilitated. Further, control of the temperature of other components is possible as is facilitating of varying temperature control strategies at different engine operating points—e.g., expedited warm-up of engine 102 may be possible in addition to partial cooling of cylinder block 108 at part-load operation such that different coolant temperatures may be realized for different load points (e.g., in some scenarios, higher coolant temperatures at low loads than at high loads). With coolant valve 130, a single component is sufficient to implement the coolant control described herein, and, for example, the use of two thermostat valves may be omitted. Thus, cost, space, and complexity may be reduced.

Turning now to FIG. 4, a flowchart illustrating a method 400 for controlling coolant flow through coolant circuit 100 and engine 102 of FIG. 1 via actuation of coolant valve 130 of FIGS. 2A and 2B is shown.

At 402, it is determined whether engine 102 is in a start-up condition. If engine 102 has recently started (YES), coolant valve 130 is placed in the fourth working position at 404 to expedite warm-up of the engine and its components (e.g., to heat engine oil to reduce friction losses).

If engine 102 is not in the start-up condition (NO), it is determined at 406 whether no cooling to cylinder head 106 is desired. If head cooling is not desired (YES), it is determined at 408 whether cooling to cylinder block 108 is desired. If block cooling is desired (YES), coolant valve 130 is placed in the first working position at 410. If block cooling is not desired (NO), coolant valve 130 is placed in the fifth working position at 412.

If it is determined at 406 that head cooling is desired (NO), it is determined whether a medium level of cooling to cylinder head 106 is desired at 414. If a medium level of cylinder head 106 cooling is desired (YES), it is determined at 416 whether cylinder block 108 cooling is desired. If cylinder block 108 cooling is desired (YES), coolant valve 130 is placed in the third working position at 418. If cylinder block 108 cooling is not desired (NO), coolant valve 130 is placed in the sixth working position at 420.

If it is determined at 414 that a medium level of cylinder head 106 cooling is not desired (NO), it is determined at 422 whether a high level of cooling to the cylinder head is desired. If a high level of cylinder head 106 cooling is desired (YES), it is determined at 424 whether cylinder block 108 cooling is desired. If cylinder block 108 cooling is desired (YES), coolant valve 130 is placed in the second working position at 426. If cylinder block 108 cooling is not desired (NO), coolant valve 130 is placed in the seventh working position at 428.

If it is determined that a high level of cylinder head 106 cooling is not desired at 422, method 400 ends. In contrast, following selection of any of the above described working positions, method 400 returns to 406 such that responsive, demand-dependent cooling may be provided to engine 102. Determination of whether head and block cooling is desired may be based on signals provided by cylinder head temperature sensor 105A and cylinder block temperature sensor 105B described above. It will be appreciated that method 400 may be adapted such that coolant valve 130 may be placed in working positions responsive to other operating parameters, including engine load and coolant temperature. Use as controlling parameters may further be made of engine conditions described above with reference to FIG. 3, including engine startup, engine running, and over-temperature conditions.

In this way, coolant valve 130 may be operated according to method 400 to independently cool cylinder head and block 106 and 108 at different rates according to demand and their respective operating characteristics. Coolant valve 130 is sufficient to facilitate demand-based independent cooling of these two components via digital control, whereas in other approaches two components are utilized via analog control to respectively control cooling of a cylinder head and block.

Note that an example method may include placing a coolant valve in a fourth working position at start-up of an internal combustion engine, the internal combustion engine including a cylinder head and a cylinder block; after placement in the fourth working position, placing the coolant valve in one of a first working position and a fifth working position; after placement in one of the first working position or the fifth working position, placing the coolant valve in one of a third working position and a sixth working position; and after placement in one of the third working position and the sixth working position, placing the coolant valve in one of a second working position and a seventh working position; wherein the coolant valve is placed in each working position via rotational selection of an angular orientation; and wherein each working position facilitates independent cooling of the cylinder head and the cylinder block based on one or more of a cylinder head temperature, a cylinder block temperature, and a coolant temperature.

Note that the example control and estimation methods included herein can be used with various engine and/or vehicle system configurations. The specific methods described herein may represent one or more of any number of processing strategies such as event-driven, interrupt-driven, multi-tasking, multi-threading, and the like. As such, various acts, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated acts or functions may be repeatedly performed depending on the particular strategy being used. Further, the described acts may graphically represent code to be programmed into the computer readable storage medium in the engine control system.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A liquid-cooled internal combustion engine, comprising:

at least one cylinder head including at least one integrated coolant jacket, the at least one integrated coolant jacket having at an inlet side a first supply opening and at an outlet side a first discharge opening, the first supply opening configured to receive coolant, the first discharge opening configured to discharge coolant;

a cylinder block including at least one integrated coolant jacket, the at least one integrated coolant jacket having at an inlet side a second supply opening and at an outlet side a second discharge opening, the second supply opening configured to receive coolant, the second discharge opening configured to discharge coolant;

a coolant valve;

a first return line including a heat exchanger, the first return line connecting the first discharge opening to the coolant valve;

a second return line connecting the second discharge opening to the coolant valve;

a supply line including a pump configured to deliver coolant to the first supply opening, the second supply opening, and the integrated coolant jackets, the supply line branching off from the coolant valve; and a bypass line branching off from the first return line upstream of the heat exchanger, the bypass line leading to the coolant valve;

wherein the coolant valve has a control drum rotatable about a longitudinal axis between working positions including a first working position and a second working position;

wherein the first working position separates the first return line from the supply line, and connects the second return line and the bypass line to the supply line, wherein the second working position separates the bypass line from the supply line, and connects the first return line and the second return line to the supply line;

wherein the control drum is driven by a stepper motor configured to rotate the control drum between working positions by a predefinable angle corresponding to at least one step of predeterminable step size, and wherein the rotatable control drum in a fourth working position separates the bypass line, the first return line, and the second return line from the supply line.

2. The liquid-cooled internal combustion engine of claim 1, wherein the rotatable control drum in a third working position connects the bypass line, the first return line, and the second return line to the supply line.

3. The liquid-cooled internal combustion engine of claim 1, wherein the rotatable control drum in a fifth working position connects the bypass line to the supply line, and separates the first return line and the second return line from the supply line.

4. The liquid-cooled internal combustion engine of claim 1, wherein the rotatable control drum in a sixth working position separates the second return line from the supply line, and connects the first return line and the bypass line to the supply line.

5. The liquid-cooled internal combustion engine of claim 1, wherein the rotatable control drum in a seventh working position connects the first return line to the supply line, and separates the second return line and the bypass line from the supply line.

6. The liquid-cooled internal combustion engine of claim 1, further comprising a coolant-operated heater.

7. The liquid-cooled internal combustion engine of claim 1, wherein the coolant valve comprises a housing in which the control drum is rotatably mounted, the housing including connection openings for the first return line, the second return line, the bypass line, and the supply line.

8. The liquid-cooled internal combustion engine of claim 1, wherein the control drum is adjusted and controlled in a predefinable cycle via the stepper motor; and wherein the predefinable cycle comprises a sequence of working positions of the control drum including the first working position and the second working position, each working position having corresponding residence times of the control drum.

9. The liquid-cooled internal combustion engine of claim 8, wherein the cycle is predefined as a function of one or more of a cylinder head temperature, a cylinder block temperature, and a coolant temperature.

10. The liquid-cooled internal combustion engine of claim 8, wherein the sequence of working positions is traversed linearly such that rotation of the control drum is minimized.

11. An internal combustion engine, comprising:

a cylinder head;

a cylinder block coupled to the cylinder head;

a first return line fluidically coupled to the cylinder head and to a coolant valve, the first return line including a heat exchanger configured to remove heat from coolant;

a second return line fluidically coupled to the cylinder block and to the coolant valve;

a bypass line branching off from the first return line, the bypass line fluidically coupled to the coolant valve; and an originating supply line fluidically coupled to the cylinder head, the cylinder block, and the coolant valve, the originating supply line including a pump configured to supply coolant;

the coolant valve configured to control coolant flow through the first return line, the second return line, the bypass line, and the originating supply line via rotational selection of one of a plurality of working positions, the plurality of working positions including a position in which the first return line, second return line, and bypass line are blocked from the originating supply line.

12. The internal combustion engine of claim 11, wherein the coolant valve includes a cylindrical body having a plurality of columnar regions each defining one of the plurality of working positions, each of the plurality of columnar regions including at least one port configured to block or allow coolant flow.

13. The internal combustion engine of claim 12, wherein the cylindrical body is positioned in a cylindrical block having an external surface including at least one connection opening fluidically coupled to one of the first return line, the second return line, the bypass line, and the originating supply line.

14. The internal combustion engine of claim 11, wherein the coolant valve has a disk-shaped body.

15. The internal combustion engine of claim 11, further comprising an actuator operatively coupled to the coolant valve, the actuator configured to drive rotational selection of one of the plurality of working positions.

16. The internal combustion engine of claim 15, wherein the actuator is a stepper motor.

17. The internal combustion engine of claim 11, wherein the plurality of working positions includes:

a first working position separating the first return line from the originating supply line, and connecting the second return line and the bypass line to the supply line;

a second working position separating the bypass line from the originating supply line, and connecting the first return line and the second return line to the supply line;

a third working position connecting the bypass line, the first return line, and the second return line to the originating supply line;

a fourth working position separating the bypass line, the first return line, and the second return line from the originating supply line;

a fifth working position connecting the bypass line to the originating supply line, and separating the first return line and the second return line from the originating supply line;

a sixth working position separating the second return line from the originating supply line, and connecting the first return line and the bypass line to the originating supply line; and a seventh working position connecting the first return line to the originating supply line, and separating the second return line and the bypass line from the originating supply line.

18. The internal combustion engine of claim 17, wherein the fourth working position is selected at start-up of the internal combustion engine;

wherein the first working position is selected following selection of the fourth working position if cooling of the cylinder block is desired;

wherein the fifth working position is selected following selection of the fourth working position if cooling of the cylinder block is not desired;

wherein the third working position is selected following selection of one of the first working position and the fifth working position if cooling of the cylinder block is desired;

wherein the sixth working position is selected following selection of one of the first working position and the fifth working position if cooling of the cylinder block is not desired;

wherein the second working position is selected following selection of one of the third working position and the sixth working position if cooling of the cylinder block is desired;

wherein the seventh working position is selected following selection of one of the third working position and the sixth working position if cooling of the cylinder block is not desired; and wherein the plurality of working positions is traversed in a sequence such that rotation of the coolant valve is minimized, the sequence based on typical temperature changes of the cylinder head and the cylinder block for typical engine operation cycles.

19. A method, comprising:

independently adjusting coolant flow to a cylinder head and block based on engine startup, engine running, and over-temperature conditions, via a rotary valve having three inlet lines and a single outlet line, the valve having at least seven distinct positions with different couplings among the inlet and outlet lines, wherein in one of the positions, all three inlet lines are blocked from the outlet line.

* * * * *